US005884673A

United States Patent [19]

Saito

[11] Patent Number: 5,884,673

[45] Date of Patent: Mar. 23, 1999

[54] PIPE

[75] Inventor: Michito Saito, Tokyo, Japan

[73] Assignee: Calsonic Corporation, Tokyo, Japan

[21] Appl. No.: 105,146

[22] Filed: Jun. 26, 1998

[30] Foreign Application Priority Data

Jun. 26, 1997 [JP] Japan ..... 9-170320

[51] Int. Cl.[6] ..... F16L 9/00

[52] U.S. Cl. ..... 138/156; 138/166; 138/171; 138/168; 138/89

[58] Field of Search ..... 138/156, 166–168, 138/170, 171, 162, 163, 89

[56] References Cited

U.S. PATENT DOCUMENTS

| | | | |
|---|---|---|---|
| 955,153 | 4/1910 | Graham | 138/166 |
| 2,884,958 | 5/1959 | Asselin, Sr. | 138/171 |
| 3,347,276 | 10/1967 | Dunn | 138/166 |
| 3,350,751 | 11/1967 | Groschke | 138/166 X |
| 3,425,456 | 2/1969 | Schibig | 138/162 |
| 3,517,702 | 6/1970 | Mueller et al. | 138/166 X |
| 4,268,559 | 5/1981 | Smuckler | 138/171 X |
| 4,422,478 | 12/1983 | Pentney et al. | 138/166 X |
| 4,513,787 | 4/1985 | Hegler et al. | 138/166 |
| 4,517,234 | 5/1985 | Fisher | 138/163 X |
| 4,951,716 | 8/1990 | Tsunoda et al. | 138/166 X |
| 5,505,230 | 4/1996 | Bartholomew | 138/166 X |

*Primary Examiner*—Patrick Brinson
*Attorney, Agent, or Firm*—Sughrue, Mion, Zinn, Macpeak & Seas, PLLC

[57] ABSTRACT

The leading end portion of a caulking pawl portion formed in the end portion of a pipe main body is formed integrally with the pipe main body through the side surface portion of the caulking pawl portion which has a larger width in the longitudinal direction thereof than the width of the leading end portion in the longitudinal direction thereof. At the same time, the leading end portion of the caulking pawl portion is also formed integrally with the cap side end of the side surface portion of the caulking pawl portion.

3 Claims, 7 Drawing Sheets

PIPE

BACKGROUND OF THE INVENTION

1. Field of the Invention

The present invention relates to a pipe which can be manufactured by molding a plate member into a cylindrical-shaped member and then connecting one side edge portion of the cylindrical-shaped member and the other side edge portion thereof to each other.

2. Description of the Related Art

Recently, in a heat exchanger such as a capacitor or the like, a tank main body is manufactured from a pipe member which is formed of aluminum.

And, conventionally, such pipe member is manufactured in such a manner that, as shown in FIG. 6, a plate member 11 is molded into a cylindrical-shaped member and, after then, one side edge portion 11*a* of the cylindrical-shaped member and the other side edge portion 11*b* thereof are connected together by brazing R.

However, in such conventional pipe member 13, if the pipe member 13 is heated up to a high temperature within a brazing furnace for the purpose of brazing, then, as shown in FIG. 7, with a point A as the center thereof, one side edge portion 11*a* and the other side edge portion 11*b* of the pipe member 13 are opened, which makes it difficult to braze together one side edge portion 11*a* and the other side edge portion 11*b* of the pipe member 13 with accuracy.

In view of this, conventionally, as shown in FIG. 8, there is employed a method in which one side edge portion 11*a* and the other side edge portion 11*b* of the pipe member 13 are previously spot welded W together at intervals and, after then, one side edge portion 11*a* and the other side edge portion 11*b* of the pipe member 13 are brazed to each other.

However, in the above-mentioned conventional manufacturing method, because one side edge portion 11*a* and the other side edge portion 11*b* of the pipe member 13 are previously spot welded W together at intervals, there arises a problem that a large number of man-hours are necessary to manufacture the pipe member 13.

Conventionally, as a method which has solved this problem, there are known a pipe and a method for manufacturing the same as follows.

FIGS. 9 to 11 respectively show the above-mentioned pipe; that is, this pipe is manufactured in such a manner that a plate member 15 is molded into a cylindrical-shaped member, and one side edge portion 15*a* and the other side edge portion 15*b* of the cylindrical-shaped member are connected to each other to thereby form a pipe main body 17.

Also, as shown in FIG. 9, in the pipe main body 17, there are formed a plurality of fitting portions 19 which are spaced at given intervals from one another.

Each of the fitting portions 19, as shown in FIG. 10, includes a securing portion 21 which is formed integrally with one side edge portion 15*a* of the pipe main body 17, and a caulking pawl portion 23 which is formed integrally with the other side edge portion 15*b* of the pipe main body 17 and also with which the securing portion 21 can be fitted from inside.

And, the leading end portion 23*a* of the caulking pawl portion 23 is bent and is stored in a securing recessed portion 25 formed on the side of one side edge portion 15*a* of the pipe main body 17.

In the present pipe, if the securing portion 21 formed integrally with one side edge portion 15*a* of the pipe main body 17 is fitted with the caulking pawl portion 23 formed integrally with the other side edge portion 15*b* of the pipe main body 17, then one side edge portion 15*a* and the other side edge portion 15*b* of the pipe main body 17 can be positively contacted together at a given position thereof, with the result that one side edge portion 15*a* and the other side edge portion 15*b* of the pipe main body 17 can be positively connected together at a given position without using spot welding.

Also, since the leading end portion 23*a* of the caulking pawl portion 23 is stored in a securing recessed portion 25 formed on the side of one side edge portion 15*a* of the pipe main body 17, the leading end portion 23*a* of the caulking pawl portion 23 is prevented from projecting beyond the outer periphery of the pipe main body 17, thereby being able to manufacture a pipe which is entirely free from troublesome projections.

However, in this pipe, as shown in FIG. 9, because the width W of the side surface portion 23*b* of the caulking pawl portion 23 is set equal to the width W of the leading end portion 23*a* thereof, when the leading end portion 23*a* of the caulking pawl portion 23 is bent, as shown in FIG. 12, the bent portion 23*c* of the caulking pawl portion 23 provides a relatively large arc shape. This raises a problem that it is difficult for the leading end portion 23*a* of the caulking pawl portion 23 to hold the-securing portion 21 positively.

In view of the above, a pipe shown in FIG. 13 which can solve the above-mentioned problem has been previously developed.

Here, FIG. 13 shows the details of the main portions of the pipe disclosed in the present cited publication; in particular, in this pipe, the width H1 of the side surface portion 27*b* of a caulking pawl portion 27 in the longitudinal direction thereof is set larger than the width H2 of the leading end portion 27*a* of the caulking pawl portion 27 in the longitudinal direction thereof.

Also, the leading end portion 27*a* is formed in the central portion of the side surface portion 27*b*, while the two edges 27*c* of the leading end portion 27*a* are formed at positions spaced apart from the two edges 27*d* of the side surface portion 27*b*.

That is, in the present pipe, because the width H1 of the side surface portion 27*b* of the caulking pawl portion 27 in the longitudinal direction thereof is set larger than the width H2 of the leading end portion 27*a* of the caulking pawl portion 27 in the longitudinal direction thereof, the rigidity of the leading end portion 27*a* is sufficiently lower than the rigidity of the side surface portion 27*b*, and also because the two edges 27*c* of the leading end portion 27*a* are formed at positions spaced apart from the two edges 27*d* of the side surface portion 27*b*, the two edges 27*c* of the root portion 27*e*, which is connected to the side surface portion 27*b*, of the leading end portion 27*a* are weak in strength. Due to these two factors, the leading end portion 27*a* of the caulking pawl portion 27 can be bent at and from the base portion 27*e* thereof into a given shape.

That is, the leading end portion 27*a* of the caulking pawl portion 27 can be bent into a given shape easily and positively.

However, in the above-mentioned pipe, as shown in FIG. 14, there is a possibility that the caulking pawl portion 27 can be situated in the neighborhood of the end portion of the pipe main body 28 thereof. In this case, when the cylindrical-shaped portion 29*a* of a cap 29 is fitted with the outer periphery of either end of the pipe main body 28, the cylindrical-shaped portion 29*a* of the cap 29 interferes with the edge of the side surface portion 27*b* of the caulking pawl portion 27, which makes it difficult to bring the cylindrical-shaped portion 29*a* of the cap 29 into fitting engagement with the pipe main body 28 with accuracy.

That is, in this pipe, the pipe main body 28 must provide different lengths according to uses but, for easy manufacture and design of the pipe, it is desirable that the setting position of the caulking pawl portion 27 to be formed in the pipe main body 28 can be used in common as much as possible. Therefore, depending on the length that is required of the pipe main body 28, there is a fear that the cylindrical-shaped portion 29*a* of the cap 29 can interfere with the edge of the side surface portion 27*b* of the caulking pawl portion 27.

SUMMARY OF THE INVENTION

The present invention aims at eliminating the drawbacks found in the above-mentioned conventional pipes. Accordingly, it is an object of the invention to provide a pipe which not only allows a caulking pawl portion to be positively caulked and fixed to a securing recessed portion but also can reduce greatly a fear that a cap to be fitted with the end portion of a pipe main body can interfere with the caulking pawl portion when compared with the conventional pipes.

According to the present invention, there is provided a pipe comprising: a pipe main body formed by molding a plate member having a first side edge portion and a second side edge portion into a cylindrical-shaped member; a securing recessed portion formed adjacent to the first side edge portion; a caulking pawl portion formed integrally with the second side edge portion, wherein the caulking pawl portion includes a side surface portion formed integrally with the second side edge portion and a leading end portion formed integrally with the side surface portion, the side surface portion having a larger width than a width of the leading end portion in a longitudinal direction of the pipe main body, and the leading end portion is bent and fixed to the securing recessed portion; and a cap fitted with an outer periphery of an end of the pipe main body, wherein the leading end portion is formed at a cap-side edge of the side surface portion so that the caulking pawl portion is formed into an L-shape.

Preferably, the plate member is formed of an aluminum clad member with a brazing layer formed thereon, and not only the first side edge portion and the second side edge portion are brazed to each other but also the securing recessed portion and the caulking pawl portion are brazed to each other.

Further, two caps are preferably fitted with both ends of the pipe main body, and a plurality of the securing recessed portions and corresponding caulking pawl portions are formed on the first and second side edge portions, wherein at least each of two most adjacent caulking pawl portions to the two caps has the L-shape in which the leading end portion is formed at the cap-side edge of the side surface portion.

According to the pipe in the present invention, since the width of the side surface portion of the caulking pawl portion in the longitudinal direction thereof is set larger than the width of the leading end portion thereof in the longitudinal direction thereof, the rigidity of the leading end portion of the caulking pawl portion is sufficiently lower than that of the side surface portion of the caulking pawl portion.

And, because one edge of the leading end portion of the caulking pawl portion is formed at a position spaced apart from one edge of the side surface portion of the caulking pawl portion, the strength of the root portion of the leading end portion to be connected to the side surface portion is weakened. That is, not only due to the lower rigidity of the leading end portion than the side surface portion but also due to the weakened strength of the root portion of the leading end portion, the leading end portion of the caulking pawl portion can be positively bent into a given shape at and from the root portion thereof.

Also, since the leading end portion of the caulking pawl portion is formed integrally with the end portion of the side surface portion on the cap-side thereof, the side surface portion of the caulking pawl portion is prevented from projecting toward the cap-side beyond the leading end portion of the caulking pawl portion, thereby being able to reduce greatly a fear that the cap can interfere with the caulking pawl portion, when compared with the conventional pipes.

Further, one side edge portion and the other side edge portion of the pipe are brazed to each other and, at the same time, the securing recessed portion and caulking pawl portion are brazed to each other. In particular, since the caulking pawl portion is caulked to the securing recessed portion to thereby be surely able to contact one side edge portion and the other side edge portion with each other at a given position, and also since such mutual contact can be kept even at high temperatures, not only one side edge portion and the other side edge portion of the pipe but also the securing recessed portions and caulking pawl portions can be positively brazed to each other.

DETAILED DESCRIPTION OF THE PREFERRED EMBODIMENTS

Now, description will be given below of a preferred embodiment of a pipe according to the invention with reference to the accompanying drawings.

Figure 1:
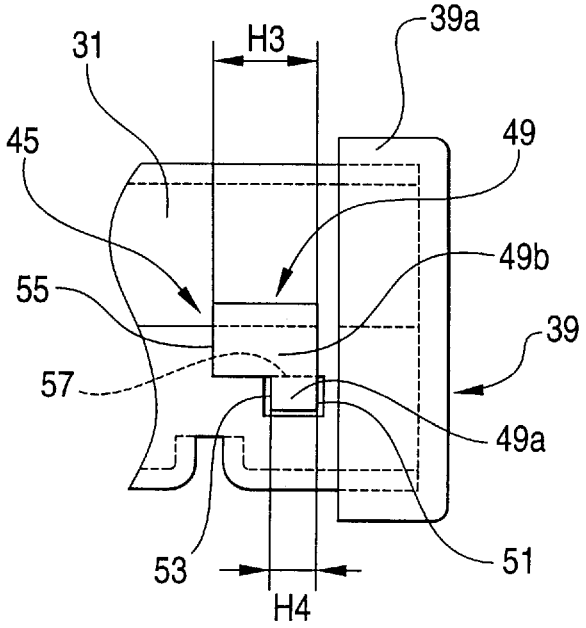
FIG. 1 is a side view of the details of the main portions of a pipe shown in FIG. 2.
Figure 2:
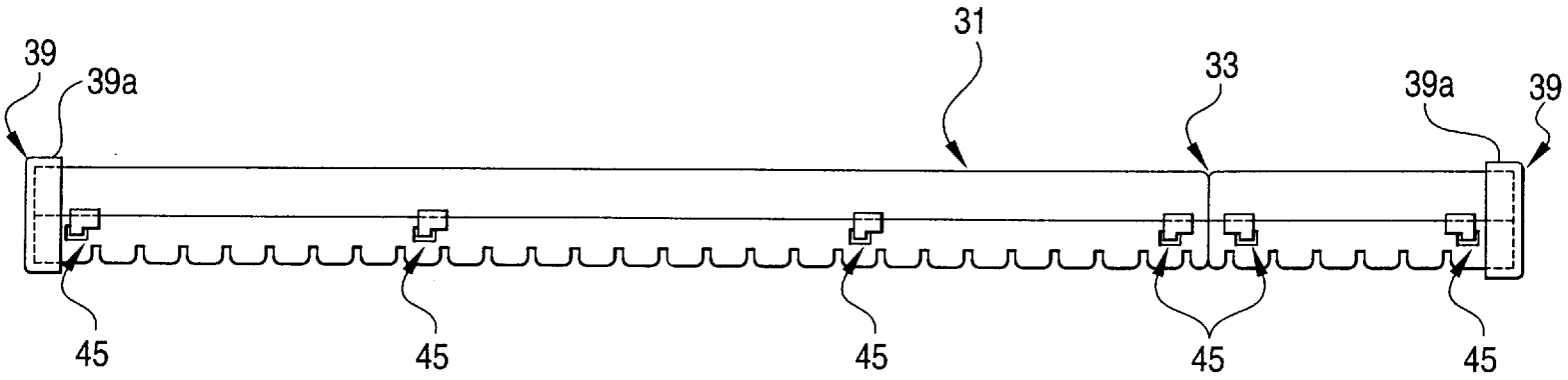
FIG. 2 is a side view of an embodiment of a pipe according to the invention.

In particular, FIGS. 1 to 4 respectively show an embodiment of a pipe according to the invention. This pipe is used as a tank for a heat exchanger such as a capacitor or the like and, as shown in FIG. 2, on one side of a pipe main body 31 of the pipe, there is formed integrally therewith a partition portion 33 which is used to partition the flow passage of a refrigerant.

Figure 5:
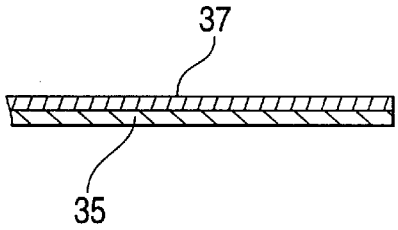
FIG. 5 is an explanatory view of a plate member which is used to form the pipe main body of the pipe shown in FIG. 1.
Figure 6:
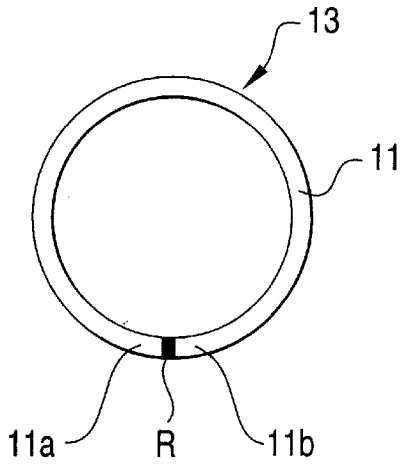
FIG. 6 PRIOR ART
FIG. 6 is an explanatory view of a conventional pipe.
Figure 7:
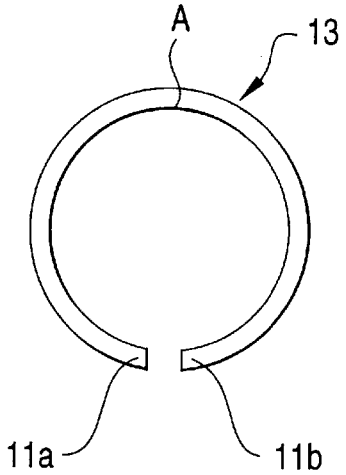
FIG. 7 PRIOR ART
FIG. 7 is an explanatory view of the above conventional pipe, showing a state thereof in which it is opened.
Figure 8:
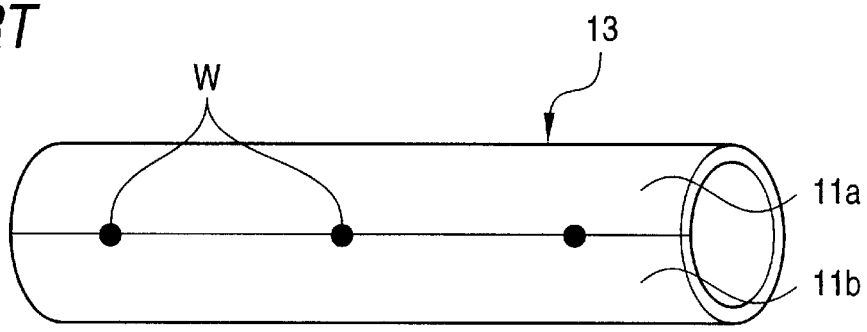
FIG. 8 PRIOR ART
FIG. 8 is an explanatory view of a conventional pipe, showing a state thereof in which it is spot welded.
Figure 9:
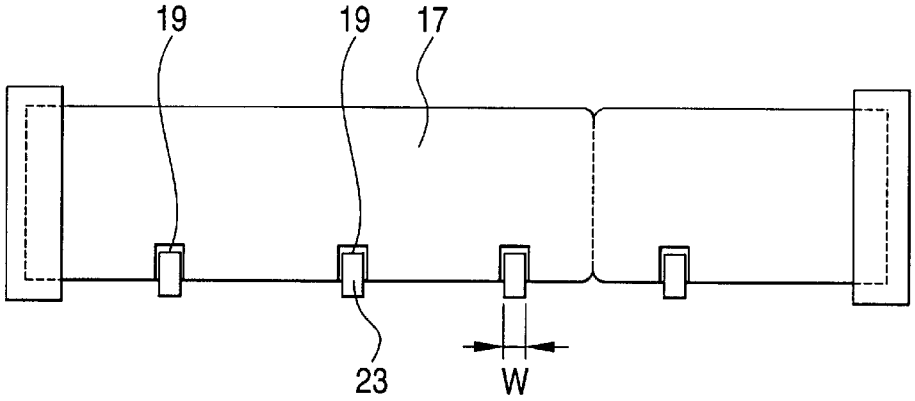
FIG. 9 is a side view of an embodiment of a pipe which has been previously applied for patent by the present applicants.
Figure 10:
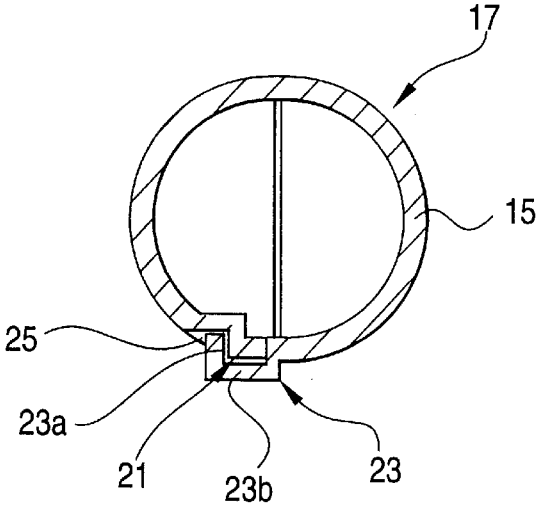
FIG. 10 is a section view of a fitting portion formed in the pipe shown in FIG. 9.
Figure 11:
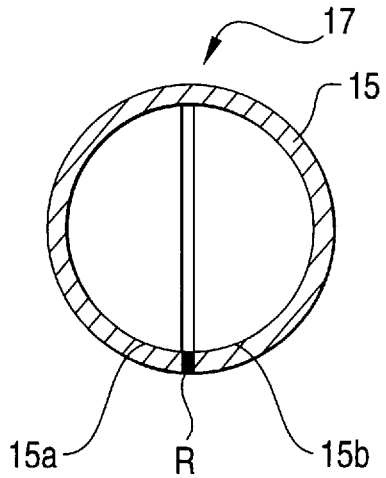
FIG. 11 is a section view of the other portions of the pipe shown in FIG. 9 than the fitting portion thereof.
Figure 12:
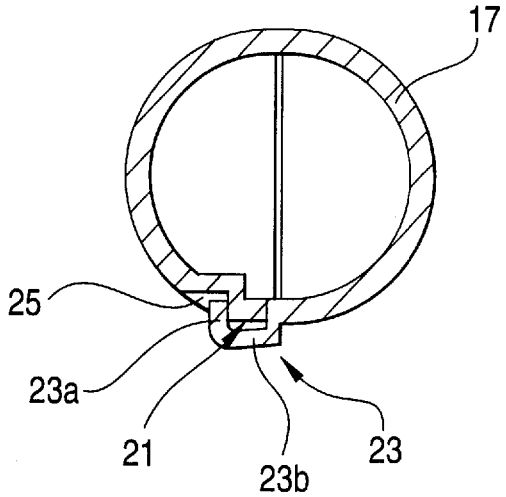
FIG. 12 is an explanatory view of the pipe shown in FIG. 9, showing a state thereof in which the leading end portion of a caulking claw portion formed therein is bent.
Figure 13:
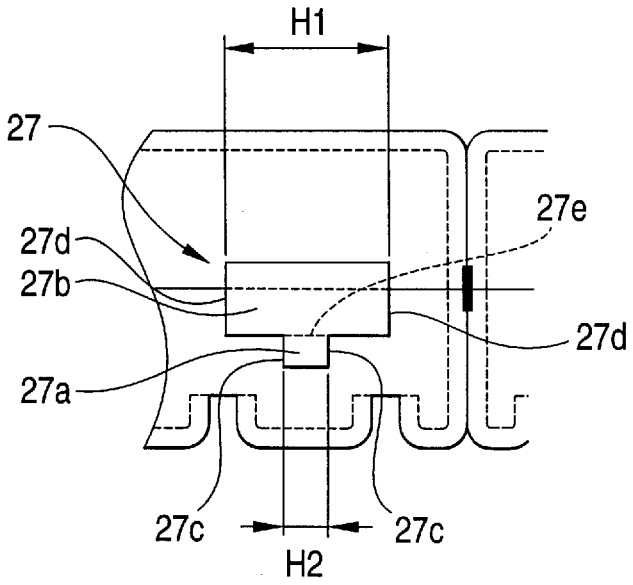
FIG. 13 is a side view of the main portions of another pipe which has been previously applied for patent by the present applicants.
Figure 14:
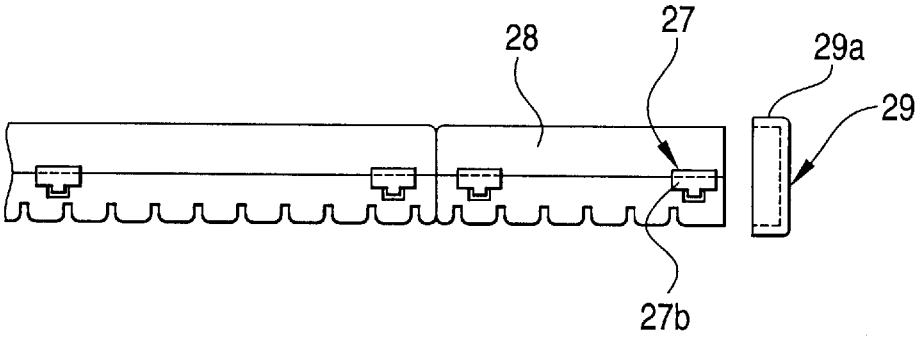
FIG. 14 is a side view of a conventional pipe, showing problems found therein.

By the way, according to the present embodiment, as shown in FIG. 5, a plate member 35 forming the pipe main body 31 is formed of an aluminum clad member and includes a brazing layer 37 on the surface thereof that provides an outer surface side thereof.

The pipe main body 31 has a cylindrical shape and, on the respective outer peripheries of the two ends of the pipe main body 31, there are fittingly placed the cylindrical-shaped portions 39*a* of caps 39 each of which is formed of aluminum.

Figure 4:
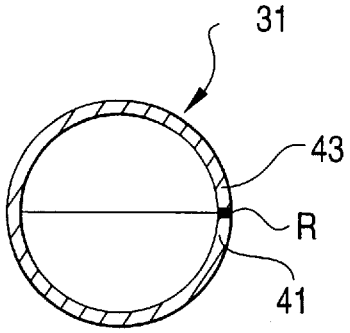
FIG. 4 is a section view of the other portions of the pipe shown in FIG. 1 than the fitting portion thereof.

One side edge portion 41 and the other side edge portion 43 of the pipe main body 31, as shown in FIG. 4, are brazed R to each other.

And, as shown in FIG. 2, in the longitudinal direction of the pipe main body 31, there are provided a plurality of fitting portions 45 which are spaced at intervals.

Figure 3:
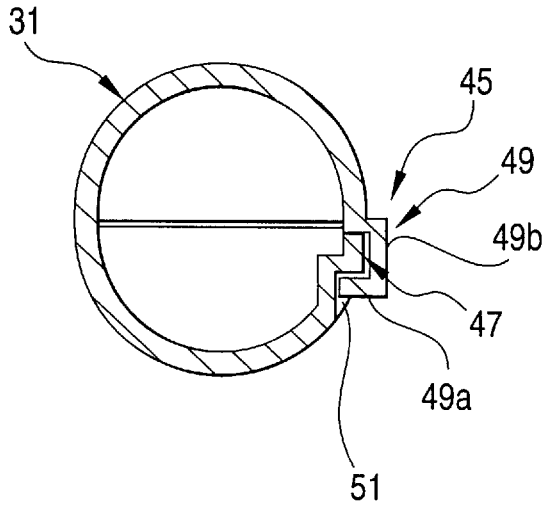
FIG. 3 is a section view of a fitting portion formed in the pipe shown in FIG. 1.

Each of the fitting portions 45, as shown in FIG. 3, includes a securing portion 47 which is formed in the neighborhood of one side edge portion 41 of the pipe main body 31, and a caulking pawl portion 49 formed integrally with the other side edge portion 43.

And, the leading end portion 49*a* of the caulking pawl portion 49 is bent and is also caulked and fixed to a securing recessed portion 51 which is formed in the neighborhood of one side edge portion 41 of the pipe main body 31.

Also, the caulking pawl portion 49 is brazed to the securing portion 47 as well as to the securing recessed portion 51.

Now, FIG. 1 shows the fitting portion 45 in an enlarged manner and, in the present embodiment, the width H3 of the side surface portion 49*b* of the caulking pawl portion 49 in the longitudinal direction thereof is set larger than the width H4 of the leading end portion 49*a* of the caulking pawl portion 49 in the longitudinal direction thereof.

Also, the leading end portion 49*a* of the caulking pawl portion 49 is formed in the end portion of the side surface portion 49*b* on the cap 39 side thereof, while one edge 53 of the leading end portion 49*a* is formed at a position spaced from one edge 55 of the side surface portion 49*b*.

In the pipe structured in the above-mentioned manner, since the width H3 of the side surface portion 49*b* of the caulking pawl portion 49 in the longitudinal direction thereof is set larger than the width H4 of the leading end portion 49*a* of the caulking pawl portion 49 in the longitudinal direction thereof, the rigidity of the leading end portion 49*a* is sufficiently lower than the rigidity of the side surface portion 49*b*.

And, because one edge 53 of the leading end portion 49*a* is formed at a position spaced from one edge 55 of the side surface portion 49*b*, the strength of one edge 53 of the root portion 57 of the leading end portion 49*a* to be connected to the side surface portion 49*b* is weakened, which, in cooperation with the lower rigidity of the leading end portion 49*a* than the side surface portion 49*b*, makes it possible to bend the leading end portion 49*a* into a given shape at and from the root portion 57 thereof.

That is, the leading end portion 49*a* can be bent into a given shape easily and positively.

Also, in the above-mentioned pipe, since the leading end portion 49*a* of the caulking pawl portion 49 is formed integrally with the end portion of the surface side portion 49*b* on the cap 39 side thereof. That is, the caulking pawl portion 49 has an L-shape. So the side surface portion 49*b* of the caulking pawl portion 49 is prevented from projecting toward the cap 39 side beyond the leading end portion 49*a* of the caulking pawl portion 49, it is possible to reduce greatly a fear that the cylindrical-shaped portion 39*a* of the cap 39 can interfere with the caulking pawl portion 49.

Further, in the above-mentioned pipe, not only one side edge portion 41 and the other side edge portion 43 of the pipe are brazed to each other but also the securing recessed portion 51 and caulking pawl portion 49 are brazed to each other. In particular, since the caulking pawl portion 49 is caulked and fixed to the securing recessed portion 51 to thereby be able to bring one side edge portion 41 and the other side edge portion 43 into positive contact with each other at a given position, and also since such mutual contact can be kept even if the temperature rises up to a high temperature in the brazing operation, not only one side edge portion 41 and the other side edge portion 43 of the pipe but also the securing recessed portion 51 and caulking pawl portion 49 can be positively brazed to each other.

By the way, in the above-illustrated embodiment, description has been given of the embodiment in which all the caulking pawl portions 49 are formed in an L shape. However, the invention is not limited to this embodiment but, of course, only the caulking pawl portion disposed in the end portion of the pipe main body can be formed in an L shape.

Also, in the above-illustrated embodiment, description has been given of the embodiment in which the pipe main body 31 includes the partition portion 33. However, the invention is not limited to this embodiment but, of course, such partition portion can be excluded.

As has been described heretofore, according to a pipe, since the width of the side surface portion of the caulking pawl portion in the longitudinal direction thereof is set larger than the width of the leading end portion thereof in the longitudinal direction thereof, the rigidity of the leading end portion of the caulking pawl portion is sufficiently lower than that of the side surface portion of the caulking pawl portion; and also, because one edge of the leading end portion of the caulking pawl portion is formed at a position spaced apart from one edge of the side surface portion of the caulking pawl portion, the strength of the root portion of the leading end portion to be connected to the side surface portion is weakened, with the result that not only the leading end portion of the caulking pawl portion can be positively bent into a given shape at and from the root portion thereof, but also the caulking pawl portions can be positively caulked and fixed to the securing recessed portions, respectively.

Also, since the leading end portion of the caulking pawl portion is formed-integrally with the end portion of the side surface portion on the cap-side thereof, the side surface portion of the caulking pawl portion is prevented from projecting toward the cap side beyond the leading end portion of the caulking pawl portion, thereby being able to reduce greatly a fear that the cap can interfere with the caulking pawl portion, when compared with the conventional pipes.

Since the caulking pawl portion is caulked to the securing recessed portion to thereby be able to bring one side edge portion and the other side edge portion of the pipe into positive contact with each other at a given position, and also since such mutual contact can be kept even at high temperatures, not only one side edge portion and the other side edge portion of the pipe but also the securing recessed portions and caulking pawl portions can be positively brazed to each other.

What is claimed is:

1. A pipe comprising:

a pipe main body formed by molding a plate member having a first side edge portion and a second side edge portion into a cylindrical-shaped member;

a securing recessed portion formed adjacent to the first side edge portion;

a caulking pawl portion formed integrally with the second side edge portion, wherein said caulking pawl portion includes a side surface portion formed integrally with the second side edge portion and a leading end portion formed integrally with said side surface portion, said side surface portion having a larger width than a width of said leading end portion in a longitudinal direction of said pipe main body, and said leading end portion is bent and fixed to said securing recessed portion; and a cap fitted with an outer periphery of an end of said pipe main body, wherein said leading end portion is formed at a cap-side edge of the side surface portion so that said caulking pawl portion is formed in an L-shape.

2. The pipe according to claim 1, wherein said plate member is formed of an aluminum clad member with a brazing layer formed thereon, said first side edge portion and said second side edge portion are brazed to each other, and said securing recessed portion and said caulking pawl portion are brazed to each other.

3. The pipe according to claim 1, wherein two caps are fitted with both ends of said pipe main body, and a plurality of said securing recessed portions and corresponding caulking pawl portions are formed on said first and second side edge portions, wherein at least each of two most adjacent caulking pawl portions to said two caps has the L-shape in which said leading end-portion is formed at the cap-side edge of the side surface portion.

* * * * *